United States Patent [19]

Swiatosz et al.

[11] Patent Number: 4,944,293

[45] Date of Patent: Jul. 31, 1990

[54] TIMED OXYGEN BREATHING APPARATUS TRAINER

[75] Inventors: Edmund Swiatosz, Maitland; Paul D. Grimmer, Winter Park, both of Fla.

[73] Assignee: The United States of America as represented by the Secretary of the Navy, Washington, D.C.

[21] Appl. No.: 374,128

[22] Filed: Jun. 23, 1989

[51] Int. Cl.[5] ..... A62B 9/02

[52] U.S. Cl. ..... 128/205.24; 128/205.23; 128/202.22

[58] Field of Search ..... 128/202.26, 205.12, 128/205.13, 205.23, 205.24, 202.22

[56] References Cited

U.S. PATENT DOCUMENTS

| | | | |
|---|---|---|---|
| 2,483,722 | 10/1949 | Bennett | 137/102 |
| 2,484,217 | 10/1949 | Gardenier | 128/205.23 |
| 2,486,427 | 11/1949 | Miller et al. . | |
| 2,867,210 | 1/1959 | Bennett | 128/204.28 |
| 2,872,923 | 2/1959 | Birch et al. . | |
| 3,385,294 | 5/1968 | Sabathie et al. | 128/205.23 |
| 3,431,931 | 3/1969 | Cupp . | |
| 3,670,575 | 6/1972 | Emerick | 128/205.23 |
| 4,203,434 | 5/1980 | Brooks | 128/205.23 |
| 4,469,097 | 9/1984 | Kelman | 128/205.22 |
| 4,471,774 | 9/1984 | Swiatosz | 128/205.12 |
| 4,498,471 | 2/1985 | Kranz et al. | 128/205.23 |
| 4,539,986 | 9/1985 | Swiatosz et al. | 128/205.13 |
| 4,606,340 | 8/1986 | Ansite | 128/205.24 |

*Primary Examiner*—Edgar S. Burr
*Assistant Examiner*—Aaron J. Lewis
*Attorney, Agent, or Firm*—Robert W. Adams

[57] ABSTRACT

A mechanical apparatus for training is disclosed that reduces the flow of air or oxygen in an oxygen breathing apparatus (OBA) to simulate the effects of an empty oxygen canister. A timer mechanism is coupled to a butterfly valve in the air passageway of the OBA. After a preselected period of time that corresponds to the alarm setting on an operational OBA that signifies a low-oxygen status, the timer mechanism begins to wind the valve into its closed position.

5 Claims, 2 Drawing Sheets

TIMED OXYGEN BREATHING APPARATUS TRAINER

BACKGROUND OF THE INVENTION

The invention relates to the field of training devices and simulators, and, more specifically, to training in the use and wearing of a supplemental air supply apparatus that involves a face mask and an exhaustable air supply.

Emergency situations are best handled by personnel skilled in competent procedures that have been acquired through experience and training. The best insurance is good thorough preparation.

Many emergencies require that the responding personnel be provided breathing apparatus to cope with toxic environments. Fires, chemical leaks, explosive atmospheres and underground operations are obvious critical environments where breathing assistance is needed. In such cases the operator must be confident in the apparatus and his own ability to operate it safely and effectively. Otherwise, his attention to the task at hand will suffer in the emergency.

For perfect realism, the apparatus itself would be used in training. But, inasmuch as operational containers of oxygen and oxygen generating devices are used with oxygen breathing apparatuses, cost becomes a significant factor when operational apparatus is employed for training.

Therefore, simulation is encouraged. Accordingly, the next best thing to the perfect realism of the apparatus itself is the apparatus, slightly modified for training. That is what the present invention provides, with an insignificant loss of realism.

Oxygen breathing apparatuses (OBA's) for the most part are closed loop systems which are not vented except by a relief valve. The oxygen canisters and oxygen generators that are used in the system have a limited reserve of breathable air. When the supply is nearly exhausted, the user must discontinue his task and exit the dangerous environment. Then, he can replace the canister with a fresh one, re-enter the dangerous environment, and resume his task. Important, of course, is that the user must be warned before the supply of oxygen is completely exhausted in order to provide for a period of time to escape. Typically, an alarm triggered by a timer is used to alert the user.

If the user persists at his task after the alarm has sounded to signify that the supply of oxygen is about to be exhausted, he will experience a difficulty in breathing that becomes progressively more severe. Finally, the user will be unable to catch a breath when the oxygen supply has been completely exhausted. The inexperienced user will feel a sense of panic when breathing becomes difficlut. His reaction will accelerate his use of oxygen, further deplete the remaining supply of oxygen, and bring about a feeling that he is suffocating. If the panic is severe enough, the period of time he has to escape the dangerous environment before the oxygen supply is exhausted will be dramatically reduced.

Accordingly, each user should experience the sensation of a decreasing supply of oxygen before he is subjected to the sensation in a dangerous environment. Thorough training, including repeated exposure to the sequence of timed alarm followed by progressive difficulty in breathing, will reduce panic during operational use of the OBA, and condition the user to quickly exit the dangerous environment and replenish his oxygen supply before resuming the task. In addition, the training will prepare the user to complete his task on limited oxygen, such as when life or property can be saved in a short period of additional time.

The prior art includes earlier work by the present inventors, such as the simulated oxygen breathing apparatus (OBA) that is described in U.S. Pat. No. 4,539,986, and the OBA simulator using supplemental oxygen that is described in U.S. Pat. No. 4,471,774. The former utilizes high pressure air bottles mounted within the breathing bags of a modified operational breathing apparatus. Air is supplied to the trainee through a plurality of regulators and valves via an air passage opened by a mechanical actuation linkage. The actuator is part of an dummy canister, and is adapted to simulate the actuation of an operational canister. Breathable air is provided to the trainee until either the bottles are exhausted or the dummy canister is removed from its engagement with the bags. The latter patent discloses an invention that comprises a training canister for use with a personal breathing apparatus wherein the canister supplements filtered air with oxygen supplied by an internal cylinder. The canister is part of an open system, and has an integral filter that communicates outside air to the breathing apparatus. Additionally, it utilizes a miniature high pressure valve to release supplemental oxygen into the system from an oxygen cylinder. The training canister simulates operational equipment in size, shape, intergation to the personal breathing apparatus, and actuation. Breathable air is provided to the trainee only after he has installed the canister and has operated its simulated actuation lever. The simulated actuation lever opens a valve to allow filtered air to enter the system, as well as a valve to allow oxygen into the system from the oxygen cylinder.

The prior art's use of a timer to dispense oxygen is shown by U.S. Pat. No. 4,469,097. Therein is disclosed for the medical field a breathing apparatus comprising a miniature canister of pressurized oxygen that can be clipped to the wearer's shirt to provide repeated short bursts of oxygen through a small tube directly to the user underneath his surgical mask as a way to supplement his breathing. The timer controls the opening and closing of a conventional solenoid valve that is in the tube between the oxygen canister and the surgical mask, to pass the small bursts of oxygen to the wearer.

Other means useful or adaptable to enhance the flow of air to a face mask in unusual circumstances when the primary source of oxygen is insufficient or unavailable, albeit for purposes other than those of the present invention, is shown by U.S. Pat. Nos. 4,606,340, 2,486,427, and 2,872,923. The first patent represents the field of improved anti-suffocation valves, the second represents rebreather valves, and the third represents manually controlled inhalation devices. None include timers or are intended for training.

SUMMARY OF THE INVENTION

An object of the present invention is to provide an oxygen breathing apparatus for use in training that simulates the restricted airflow to the trainee that occurs operationally when the oxygen supply is nearing empty. Another object is to provide such an apparatus that is safe for use by a trainee. Other objects of the present invention are to be adaptable for use as a modification, or part of a modification, to an operational oxygen breathing apparatus, and to be simple, inexpensive and reliable.

The present invention comprises a mechanical apparatus for reducing the flow of air in oxygen breathing apparatus (OBA) after a preselected period of time to simulate the characteristics of the operational equipment, wherein a timer mechanism dependent on the equipment's timer is coupled by cable to a bufferfly valve in the air passage of the OBA and begins to wind the valve into a closed position at the expiration of said period.

DESCRIPTION OF A PREFERRED EMBODIMENT

Figure 1:
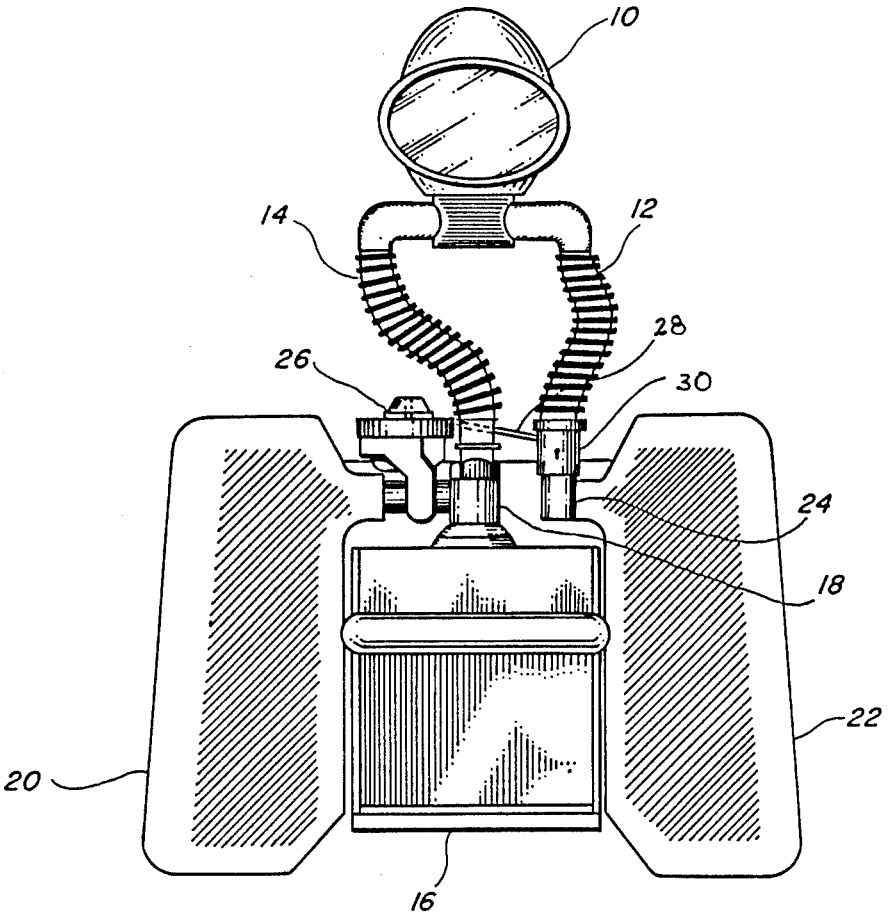
FIG. 1 is a diagrammatic view of an oxygen breathing apparatus (OBA) or OBA simulator modified to include a timer, drive cable and bufferfly valve adapter for simulating an expiring oxygen supply to the trainee; and, FIG. 2 is a top-down view partially in cutaway form of the primary components of the modification shown in FIG. 1.
Figure 2:
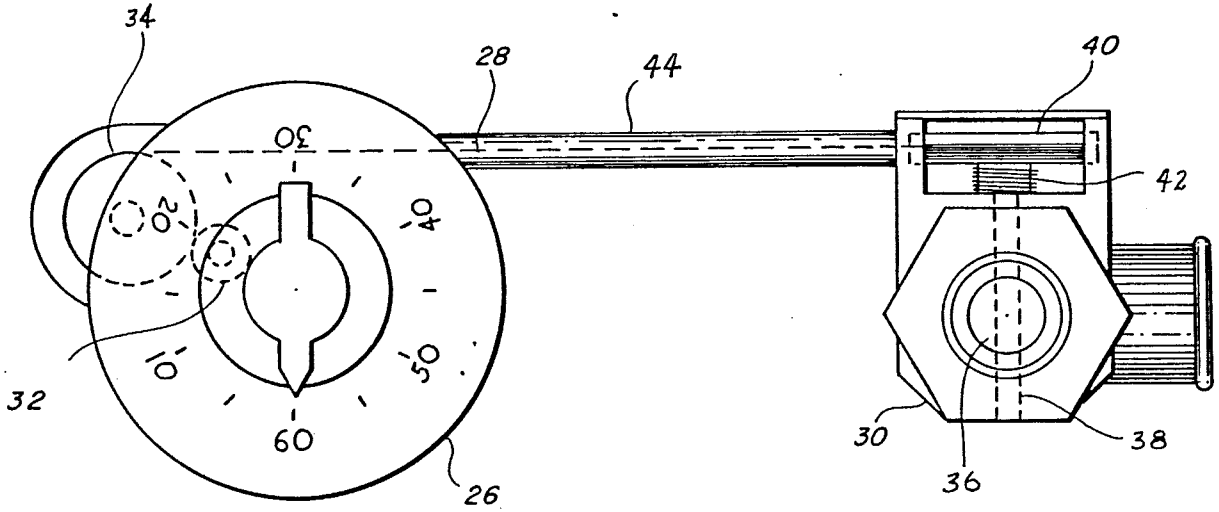

The embodiment shown in FIGS. 1 and 2 may be installed as a permanent part of a training device specifically prepared to simulate the experience of using an oxygen breathing apparatus (OBA), or it may be in the form of a kit or modification applicable to an operational OBA or simulated OBA and removeable or non-removeable therefrom. For fidelity in training it is recommended, whether the device be an operational OBA that has been modified or adapted for training, or a simulator having such as a dummy oxygen canister, that the device substantially duplicate the look, feel and operation of the operational OBA.

FIG. 1 shows an embodiment of the invention as an addition to an oxygen breathing apparatus (OBA). The additional components comprise a modified timer with its mounting bracket or, in lieu thereof, an attachment to the timer found on the operational OBA, an adapter housing a butterfly valve, and an enclosed cable operably connecting the timer to the valve. With the present invention installed or made a part of the device, the OBA includes face mask 10 cooperating with inhalation tube 12 and exhalation tube 14 to provide oxygen or breathable air to the user from canister or source 16. All or substantially all of the oxygen provided to the user of an OBA is provided by a canister installed in the OBA at the location of source 16 and communicated through fixture 18. From fixture 18 the oxygen passes through a first open-ended tube (not shown) within bag 20 whereat it is dumped into bag 20, causing both bags 20 and 22 to inflate. Within bag 22 the oxygen enters a second open-ended tube (not shown) and passes through fixture 24 into inhalation tube 12. From face mask 10 exhaled air passes through exhalation tube 14 and is vented or returned to the canister for recharging with oxygen. An operational oxygen canister is limited in the duration of time that it is able to generate or provide oxygen. Therefore, in order to warm the user that the period of safety is about to expire, many OBA's include an audible alarm that is triggered by a timer after the preselected period of time. The operational timer, or a simulated or adapted timer, is shown at timer 26. Also, timer 26 is shown in the embodiment to include components comprising the present invention. Other components of the present invention in the embodiment include drive cable 28 and adapter 30. Adapter 30 can be installed in-line between fixture 24 and tube 12 on the inhalation side of the apparatus. Adapter 30 houses a butterfly valve that can be turned into a closed position by cable 28 to restrict the flow of air from bag 22 to tube 12. In turn, cable 28 is under the control of timer 26, as will be discussed with reference to FIG. 2.

FIG. 2 shows timer 26, butterfly valve adapter 30 and drive cable 28, that also are shown in FIG. 1. Timer 26 may be the timer included on an operational OBA, adapted or modified as follows, or timer 26 may be designed for the simulation or training purpose of the present invention. Timer 26 shown in the embodiment of FIGS. 1 and 2 is the timer of an operational OBA modified to include drive gear 32 and cable wheel assembly 34. Adapter 30 is designed to be placed between fixture 24 and inhalation tube 12. Adapter 30 includes butterfly valve disc 36 attached to shaft 38 and rotatable therewith. Shaft 38 is fixed to cable drum 40, and rotationally biased by torsion spring 42. Interconnecting cable 28 is fully enclosed by enclosure 44 for reasons of safety.

Disc 36 acts as a flow restrictor in the airflow path of the apparatus. Note that in FIG. 2 it is shown in the fully closed position, and yet only occupies approximately 40 percent of the pathway. That amount of restriction is effective to cause breathing difficulties for the user and appropriately simulates the experience of diminished oxygen in the use of an operational OBA. Other sizes may be selected for disc 36 to achieve more or less restriction as deemed preferable for the training experience.

Torsion spring 42 biases shaft 38 and disc 36 toward a normally open position that would freely allow the passage of oxygen in the airflow path in the event of failure in the mechanical linkage or gears. Before timer 26 is manually wound to a time setting, disc 36 is held in a closed position against spring 42 by assembly 34, drive gear 32 and operational timer 26. The act of setting a time on timer 26 either returns disc 36 to its normally open position or rotates gear 32 and assembly 34 to withdraw cable 28 from drum 40 and turn shaft 38 and disc 36 forward against spring 42 into its next open position. Inasmuch as gear 32 is interconnected to the alarm spring shaft of the OBA and may be mounted on it, disc 36 will remain in its open position until timer 26 has wound down to zero, triggering the OBA's audible alarm. The alarm spring shaft rotates upon triggering by timer 26, and as it does it turns gear 32 which drives assembly 34 as a reel either to wind-up or wound-down cable 28 and rotate disc 36 into its closed position. The choice of wind-up, or wind-down, will determine the direction of rotation of assembly 34 or the manner in which cable 28 is attached to it, and will be made on the decision whether disc 36 is to be rotated by shaft 38 against spring 42 forward into the next closed position, or with the assistance of spring 42 back to the previous closed position in which disc 36 was before timer 26 was manually set to a time and the butterfly valve was opened. Preferably, choices will be made that cause a minimal rotation of shaft 38 in order to reduce wear on the components. For example, if the original open position of disc 36 under the bias of spring 42 is A, and the first closed position at setup is B, then setting a time on timer 26 returns disc 36 to open position A and winding down the timer to zero triggers the alarm spring to return disc 36 to closed position B.

Drive gear 32 and cable wheel assembly 34 may be mounted on a separate plate (not shown) within the existing operational OBA timer assembly. It the existing timer shaft is extended about one-half inch, space within the timer housing will be made available to mount drive gear 32 and cable wheel assembly 34. Drive gear 32 can be accommodated by the existing slot on the bell power spring shaft of the operational OBA, and can be held in place by the existing housing mounts.

The configuration shown in the preferred embodiment was selected, at least in part, to place restrictor near the inlet to the face mask. The placement shown in the Figs., between the outlet from the breathing bags and the inlet to the face mask, is close enough to the face mask to avoid the transient air flow effects that might occur if the restrictor were placed further upstream on the inhalation side. However, such a placement positions the restrictor across from the existing bell-timer device on the operational OBA. Accordingly, the selected configuration necessitates a linkage to connect the cable wheel assembly near the bell-timer to the butterfly valve restrictor on the inhalation side of the apparatus, a linkage that is provided in the embodiment by the drive cable.

From the foregoing description, it readily may be seen that the present invention comprises a new, unique, and exceedingly useful timed breathing restrictor for training which constitutes a considerable improvement over the known prior art. Obviously, many modifications and variations of the present invention are possible in light of the above teachings. It is, therefore, to be understood that within the scope of the appended claims the present invention may be practiced otherwise than as specifically described.

What is claimed is:

1. In an apparatus that can be utilized as a simulator of a breathing apparatus that is used as a means to provide the user with a supply of oxygen that is exhaustible within a predictable period of time and that has a face mask to be worn by the user with an inhalation tube attached thereto to communicate breathable air from a reservoir upon demand by the user until the oxygen supply is exhausted, an improvement to said simulator to diminish the supply of oxygen at the expiration of said period and simulate for the trainee the corresponding experience encountered by the user of the operational breathing apparatus, comprising:

means associated with said inhalation tube and operable for restricting the flow of said breathable air;

means responsive to said time period and coupled to said flow restricting means for operating said flow restricting means at the expiration of said time period;

wherein said flow restricting means comprises a valve within the airflow path to said trainee and upstream said reservoir, and said operating means is a mechanism external the airflow path that is connected to said restricting means by a mechanical linkage;

wherein said restricting means includes a housing attachable to, and in the airflow path between, said reservoir and said inhalation tube, and said valve is a butterfly valve affixed to a shaft extending external the airflow path;

wherein said shaft is spring loaded to position said valve in a normally open position to permit maximum airflow from said reservoir to said inhalation tube, and wherein said shaft includes an enlarged portion forming an axial drum; and, wherein said mechanical linkage is attached to said drum and windable thereabout such that when said linkage is withdrawn tangentially from about said drum, said drum, shaft and butterfly valve are caused to rotate about the axis of said shaft and thereby alter the orientation of said path valve within and with respect to said airflow path.

2. The apparatus of claim 1 wherein said breathing is an oxygen breathing apparatus (OBA) training device having first and second interconnected inflatable bags, a fixture communicating with said first bag for receiving an oxygen generating canister and having a canister affixed thereto, and wherein said reservoir is said second inflatable breathing bag having a fixture to which said restricting means housing is attached such that said housing couples the second breathing bag to the inhalation tube, and further wherein said device has a manually settable timer and audible alarm component activated by the timer at the expiration of the set time period, which period is said time period at the expiration of which operating means operates said restricting means.

3. The apparatus of claim 2 wherein said operating means includes a reel coupled to said alarm component and driven rotationally thereby when the component is activated by said timer, and attached to said linkage to withdraw said linkage from said drum when the reel is driven rotationally.

4. The apparatus of claim 3 wherein said operating means further includes a drive gear in engagement with said alarm component for driving said reel, and wherein said linkage is a flexible cable.

5. The apparatus of claim 4 wherein said valve is spring loaded by a torsion spring, and, said valve is in its closed position to said air flow when the setting on said timer is at zero, is opened by rotating said timer to set a time period, and is returned to its first closed position at the expiration of the time period.

* * * * *